US006191767B1

(12) United States Patent
Mano et al.

(10) Patent No.: US 6,191,767 B1
(45) Date of Patent: Feb. 20, 2001

(54) MULTI-TONE DISPLAY DEVICE

(75) Inventors: Hiroyuki Mano; Kiyokazu Nishioka, both of Yokohama; Toshio Futami, Mobara; Kiyoshige Kinugawa, Chiba-ken, all of (JP)

(73) Assignee: Hitachi, Ltd., Tokyo (JP)

( * ) Notice: Under 35 U.S.C. 154(b), the term of this patent shall be extended for 0 days.

(21) Appl. No.: 08/466,188

(22) Filed: Jun. 6, 1995

Related U.S. Application Data

(63) Continuation of application No. 08/164,563, filed on Dec. 10, 1993, now abandoned, which is a continuation of application No. 07/844,965, filed on Feb. 28, 1992, now Pat. No. 5,298,912, which is a continuation of application No. 07/475,849, filed on Feb. 6, 1990, now abandoned.

(30) Foreign Application Priority Data

Mar. 20, 1989 (JP) ..... 1-066102

(51) Int. Cl.[7] ..... G09G 3/38

(52) U.S. Cl. ..... 345/90; 348/572; 345/76; 345/87; 345/89; 345/94; 345/99

(58) Field of Search ..... 348/572; 345/76, 345/87, 89, 94, 99; 395/90, 98

(56) References Cited

U.S. PATENT DOCUMENTS 3,972,040 * 7/1976 Hilsum et al. ..... 345/76
4,353,062 * 10/1982 Lorteije et al. ..... 345/147
4,571,584 * 2/1986 Suzuki ..... 345/94
4,745,461 * 5/1988 Shirai et al. ..... 348/572
4,748,444 * 5/1988 Arqi ..... 345/99
4,766,430 * 8/1988 Gillette et al. ..... 345/89
4,775,891 * 10/1988 Aoki et al. ..... 345/87

* cited by examiner

*Primary Examiner*—Amare Mengistu
(74) *Attorney, Agent, or Firm*—Antonelli, Terry, Stout & Kraus, LLP.

(57) ABSTRACT

This specification discloses a novel multi-tone display matrix display device. The matrix display device according to an embodiment of the present invention comprises a matrix display panel having a matrix composed of plural X direction signal lines and plural Y direction signal lines lying at right angles thereto, intersecting points on the matrix being pixels of an image to be displayed, an X direction driving section for sequentially scanning the X direction signal lines to provide image signals, a Y direction driving section for driving the Y direction signal lines in synchronism with the scanning of the X direction signal lines to sequentially provide select signals to the Y direction signal lines, an A-D converter section for receiving an analog signal and converting it into a digital signal, a voltage generating section for generating signals at plural voltage levels, and a selector section for selecting an output signal from the voltage generating section in accordance with the output from A-D converter section and providing it to the X direction driving section as an image signal.

25 Claims, 9 Drawing Sheets

MULTI-TONE DISPLAY DEVICE

This application is a continuation of Ser. No. 08/164,563, filed Dec. 10, 1993 now abandoned, which is a continuation application of Ser. No. 07/844,965, filed Feb. 28, 1992 is now U.S. Pat. No. 5,298,912, which is a continuation application of Ser. No. 07/475,849, filed Feb. 6, 1990, now abandoned.

BACKGROUND OF THE INVENTION

The present invention relates to a matrix display device, and more particularly to a device for displaying an image in plural tones in response to an analog image signal.

In recent years, matrix display devices including a liquid crystal display, a plasma display, an EL (electroluminescence), etc. have been developed as display devices in place of CRT display devices.

The display screen of the matrix display device has plural X signal lines arranged in a horizontal (X) direction of the screen, and plural Y signal lines in a vertical (Y) direction thereof; each of picture cells (pixels) is displayed at each of intersecting points of the X and Y signal lines. The X signal lines are supplied with image signals (luminance or color signals), whereas the Y signal lines are supplied with selective signals for scanning lines.

Several techniques of the display for the matrix display device, which can make the display with multi-color and multi-tone as in the CRT display device, have been developed. For example, in the liquid crystal matrix display device, different tones can be exhibited in terms of different integration values of transmission light beams for liquid crystal cells. The different integration values of transmission light beams can be exhibited by thinning out image signals for each frame of the image display, or pulse-width modulating the image signals supplied to the X signals. In these techniques, the difference in time-integration values of image signals are converted into different tones. On the other hand, if the liquid crystal devices which continuously vary in their transmissivity in accordance with varying applied voltages is used, it is possible to exhibit the tone by controlling the applied voltage.

JP-A-62-195628 filed on Jan. 13, 1986 by HITACHI, LTD. in Japan discloses a liquid crystal display device which provides monochrome or 8 (eight)-color display in accordance with input signals which are binary digital signals. JP-A-61-75322 filed on Sep. 20, 1984 by FUJITSU GENERAL Co. Ltd. discloses a system which provides tone display by changing signal levels between adjacent fields. JP-A-59-78395 filed Oct. 27, 1982 by SUWA SEIKOSHA Co. Ltd. discloses a multi-tone display system using pulse-width modulation.

Now referring to FIGS. 1 and 2, the operation of a liquid crystal matrix display device which does not have the function of tone display will be explained. An input signal for this matrix display device is a binary digital signal represented by the value of "0" or "1".

In FIG. 1, 1 is a liquid crystal display device (or liquid crystal display module, hereinafter referred to as LCM) provided with a matrix shape liquid crystal panel 17 the pixels of which are selected by X signal lines and Y signal lines. 18 is display data in which display ON (white) is represented by "1" and display OFF (black) is represented by "0". 3 is a latch clock in synchronism with the display data 18. 4 is a horizontal clock indicative of the period during which the amount of display data corresponding to one horizontal display is sent. 5 is a head line signal. 19 is a voltage generating section. 20 is a display ON voltage. 21 is a display OFF voltage. 13 is a selected voltage. 14 is a non-selected voltage. These voltages are generated by the voltage generating section. 22 is an X driving section for driving X-signal lines which is reset by the trailing edge of the horizontal clock, takes in the display data 18 corresponding to one horizontal display, converts the display data taken in into a display ON voltage for the data "1" and into a display OFF voltage for the data "0", and finally outputs the converted voltage in accordance with the next trailing edge of the horizontal clock 4. X1–X640 are panel data which are output voltages from the X driving section. 16 is a Y driving section for driving Y signal lines. Y1–Y200 are scanning signals. The Y driving section 16 takes in the head line signal in accordance with the trailing edge of the horizontal clock 4, initially takes the scanning signal Y1 as the selected voltage 13, and shifts the selected voltage 13 in the order of scanning signals Y2, Y3, . . . Y200 (each of the scanning signals other than the scanning signal which is a selected voltage 13 is a non-selected voltage 14). The liquid crystal panel 17 displays data on the line corresponding to the scanning signal Y1 which is at the level of the selected voltage in accordance with the panel data X1–X640 which are X-signal-line driving voltages X1–X640 generated from the X driving section 22.

FIG. 2 is a timing chart for explaining the operation of the LCM 1.

In FIG. 1, the X driving section 22 successively takes in the display data for each one line in synchronism with the latch clock 3 and in accordance with the subsequent horizontal clock 4, outputs as panel data X1–X640, the display ON voltage 20 or the display OFF voltage selected by "1" or "0" of each data. As shown in FIG. 2, therefore, the X driving section 22 outputs the voltage selected by the data for a 200-th line which is a last line while taking in a first line data, and outputs the voltage selected by the first line data while taking in a second line data. Namely, the output of display data lags by one line from the take-in thereof. Then, in order that the scanning signal on the line to be output by the X driving section 22 is the selected voltage, the Y driving section 16 takes in the head line signal 5 at the timing of the horizontal clock 4, takes the scanning signal Y1 as the selected voltage 13 and thereafter shifts the selected voltage 13 in accordance with the horizontal clock 4. In accordance with the voltage of each of the panel data X1–X640, the display panel 17 displays "white", on the line corresponding to the scanning line which is the selected voltage, when it is the display ON voltage and displays "black" when it is the display OFF data.

Color display (8 color display) can be made by arranging color filters of red, green and blue in the direction of lines (Y direction) or the direction of dots (X direction), and additively mixing three dots (3 bit data) constituting one dot (pixel) of visible information through display ON or OFF thereof.

Meanwhile, development of multi-color and multi-tone display in accordance with the demand for multi-color display and multi-tone display gave rise to a problem of interface between information processing devices such as between a liquid crystal panel and a personal computer. More specifically, if 4096 colors are to be displayed, signal lines corresponding to 4 bits are required for each of R (red), G (green) and B (blue) so that a total of 12 signal lines are required. Further, if 32768 colors are to be displayed, signal lines corresponding to 5 bits (total of 15 signal lines) are required for each of R, G and B. Increase in the number of signal lines will complicate the interface between e.g. the display panel and the personal computer and give rise to unnecessary radiation. This can be prevented by using analog input signal lines.

SUMMARY OF THE INVENTION

An object of the present invention is to provide a new matrix display device in a multi-tone display system which is different from the conventional matrix display systems.

In the display device according to an embodiment of the present invention, an analog signal is used as an input signal. The analog signal is A-D converted into a digital signal. A voltage generating device is provided to generate, plural voltages in accordance with tones to be displayed. An output voltage from the voltage generating device is selected in accordance with the value represented by the digital signal. The selected voltage is applied to a display element to display a desired tone.

A matrix display device according to an embodiment of the present invention comprises a matrix display panel having a matrix composed of plural X direction signal lines and plural Y direction signal lines lying at right angles thereto, intersecting points on the matrix being pixels of an image to be displayed, an X direction driving section for sequentially scanning the X direction signal lines to provide image signals, a Y direction driving section for the Y direction signal lines in synchronism with the scanning of the X direction signal lines to sequentially provide select signals to the Y direction signal lines, an A-D converter section for receiving an analog signal and converting it into a digital signal, a voltage generating section for generating signals at plural voltage levels, and a selector section for selecting an output signal from the voltage generating section in accordance with the output from A-D converter section and providing it to the X direction driving section as an image signal.

DESCRIPTION OF THE PREFERRED EMBODIMENTS

Figure 1:
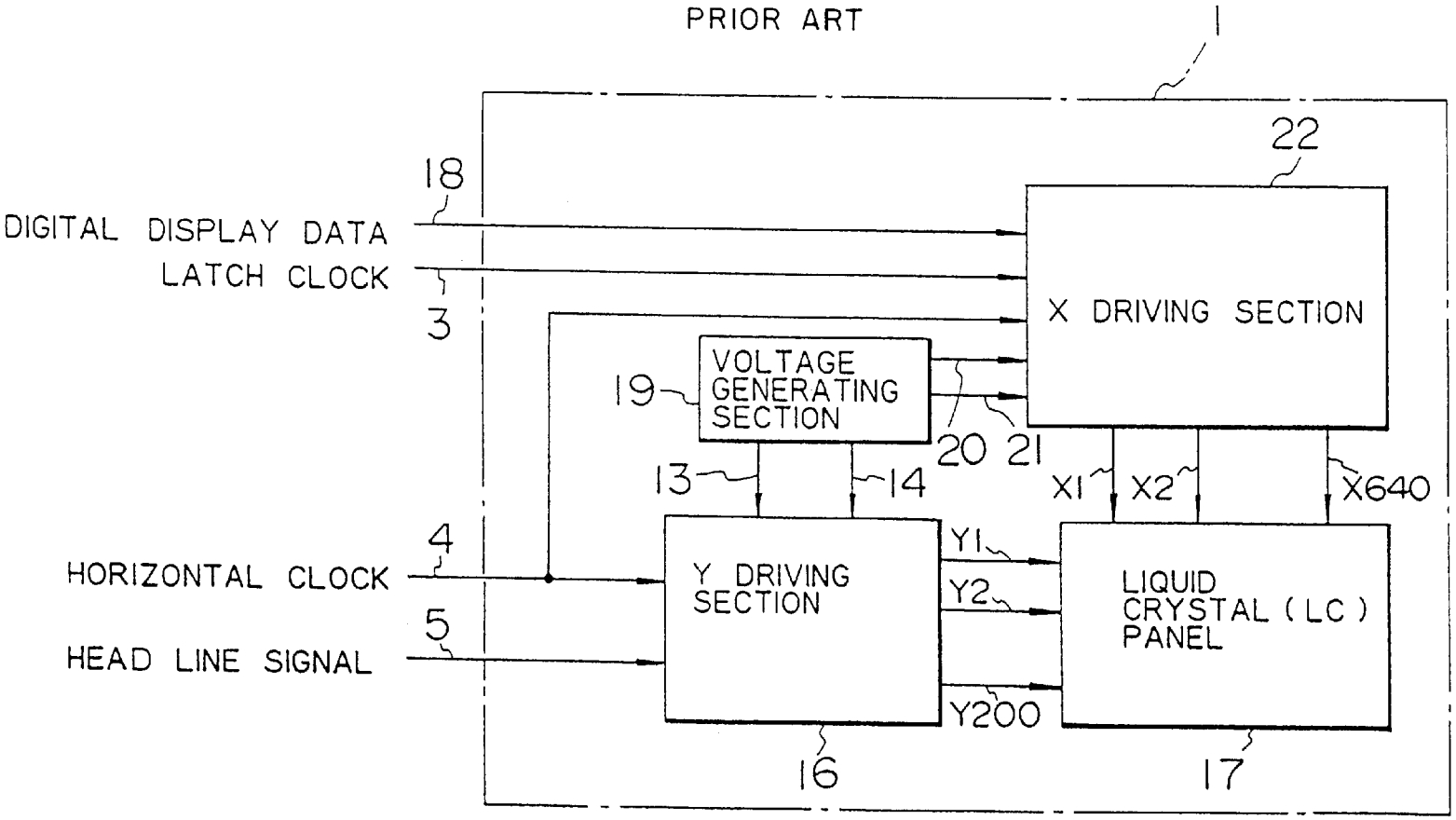
FIG. 1 PRIOR ART
FIG. 1 is a block diagram of a liquid crystal matrix display device for displaying an image in response to a digital signal input.
Figure 3:
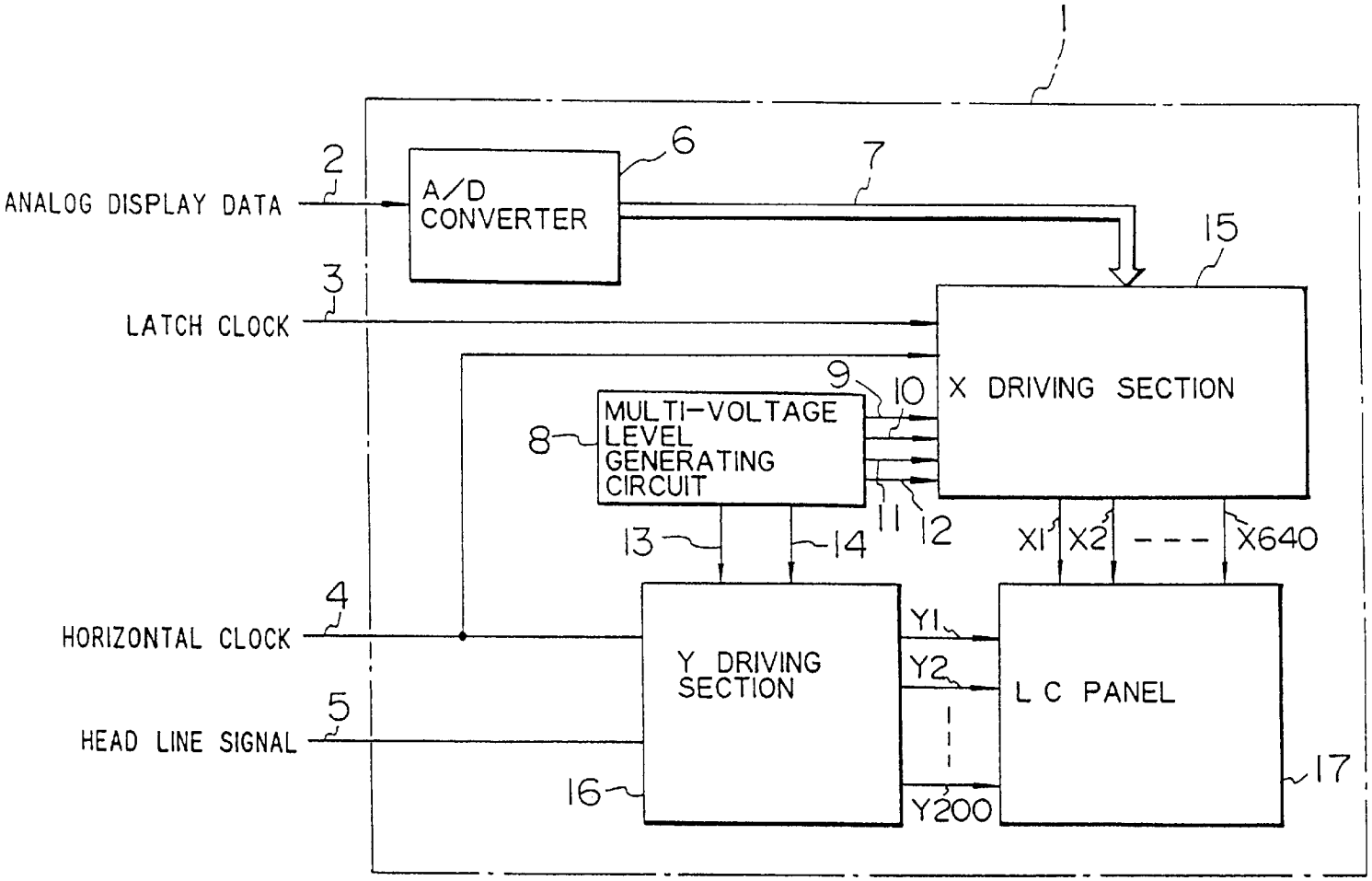
FIG. 3 is a block diagram of a liquid crystal matrix display device according to a first embodiment of the present invention.
Figure 4:
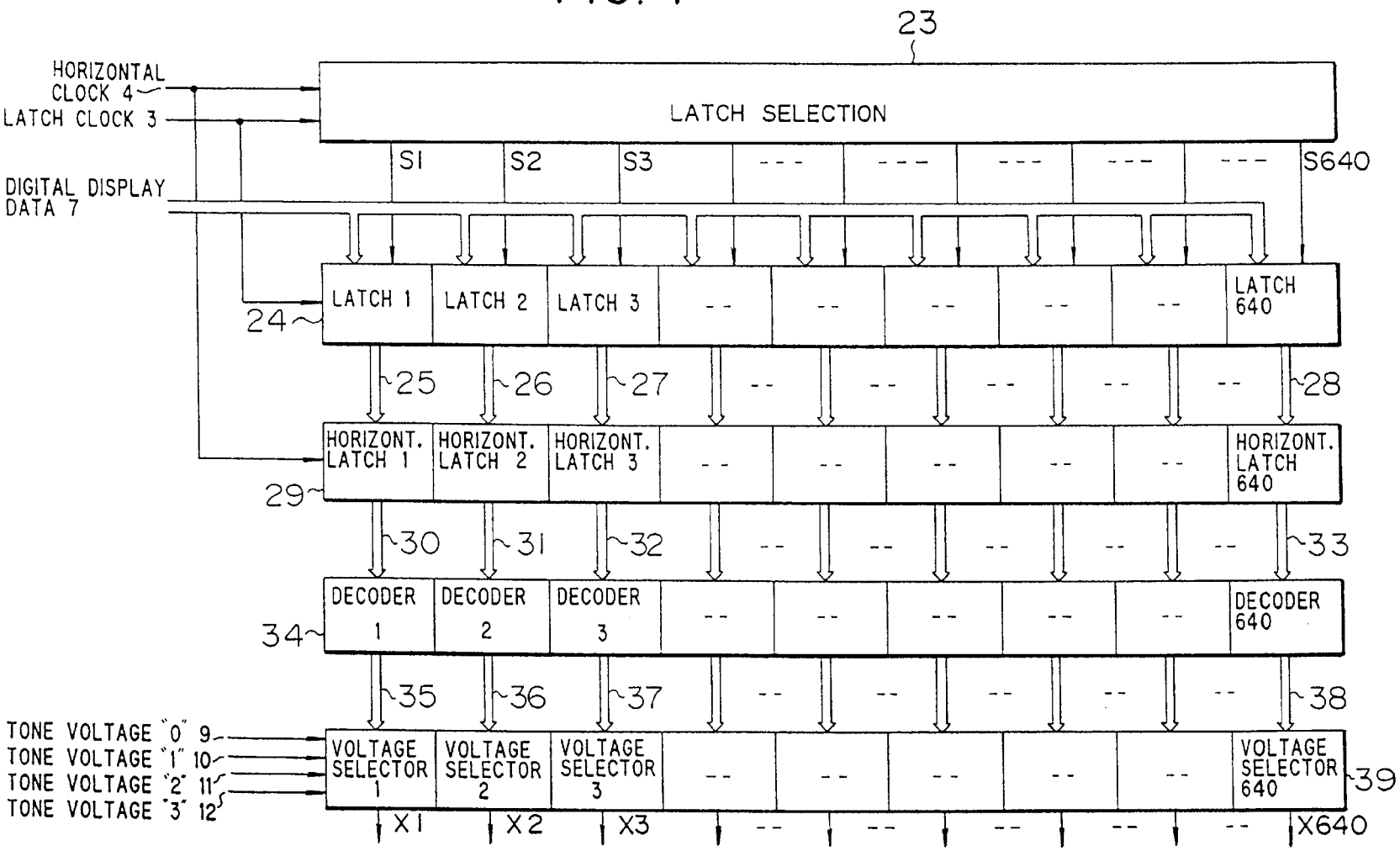
FIG. 4 is a block diagram of an example of the X driving section of FIG. 3.

Now referring to FIGS. 3 and 4, an embodiment of a multi-tone display LCM is illustrated according to the present invention. In this embodiment, it should be noted that an analog display data or signal (stepwise analog signal) 2 having different voltage levels corresponding to the number N of tones to be displayed is input to the display device. For simplicity of explanation, it is assumed that N=4, the analog input signal is represented by the voltage levels corresponding to 4 (four) tones. The analog signal is sent from an image display output of e.g. a personal computer. In FIG. 3, 6 is an A-D converter section; 7 is a digital display data. The A-D converter section 6 converts the analog display data 2 as an input into the digital display data which is represented by 2 bits; more specifically, four value voltage levels of the analog display data are converted into (0, 0), (0, 1), (1, 0), and (1, 1) from the lower levels. 8 is a multi-voltage-level output generating circuit for generating constant voltages at plural levels in accordance with tones to be displayed, e.g. voltages at four different levels since this embodiment is directed to 4 tone display. The signal at the voltage level corresponding to tone 0 is output to a signal line 9. The signals at voltage levels corresponding to tone 1, tone 2 and tone 3 are output to signal lines 10, 11, and 12 respectively. 15 is an X driving section which takes in 2 bit digital data 7 sequentially one line at a time in synchronism with the latch clock 3, selects one of the four tone voltages output to the signal lines 9, 10, 11 and 12 in accordance with the decoded value of data for each dot and outputs it as panel data X1–X640. The remaining reference numbers denote like parts in FIG. 1.

FIG. 4 shows an example of the X driving section shown in FIG. 3. In FIG. 4, 23 is a latch selector and S1–S640 are select signals. The latch selector 23 is cleared by horizontal clock 3 and sequentially boosts the select signals S1, S2, . . . S640 "high" in synchronism with the succeeding clocks 3. 24 is a latch circuit which serves to latch the digital display data 7 in blocks (latch 1–latch 640) in which the select signal is "high". 25 to 28 are outputs from the respective blocks of the latch circuit 24, i.e. 2 bit latch data 1 to 640. 29 is a horizontal latch circuit which latches the latched data 1 to 640 in horizontal latches 1 to 640 in synchronism with the horizontal clock 4. 30 to 33 are outputs from the respective blocks of the horizontal latch circuit 29, i.e. 2 bit horizontal data 1 to 640. 34 is a decoder which serves to decode the horizontal data 1 to 640 by the corresponding decoder blocks (decoders 1 to 640). Numerals 35 to 38 are outputs from the decoder blocks, i.e. decoded values 1 to 640. Numeral 39 indicates a voltage selector which serves to select one of the tone voltages in accordance with the decoded values 1–640.

Figure 2:
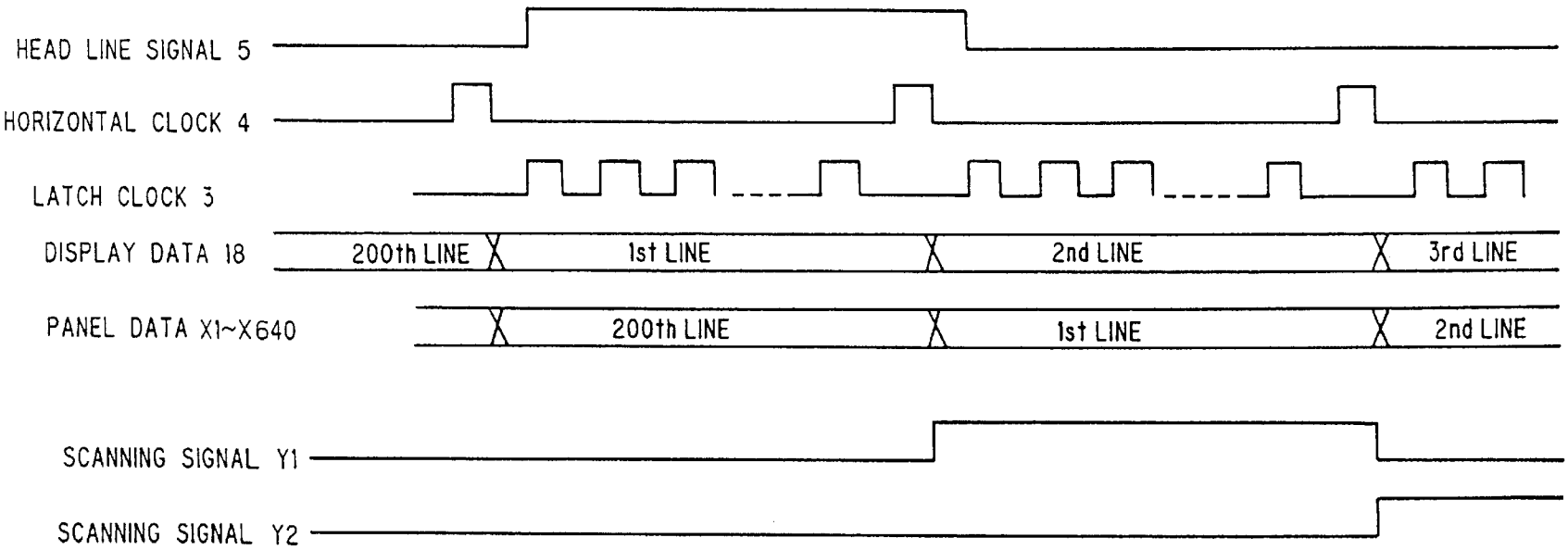
FIG. 2 PRIOR ART
FIG. 2 is a waveform chart for explaining the operation of the display device of FIG. 1.

Now referring to FIGS. 3 and 4, the operation of the multi-tone display LCM 1 shown in FIG. 3 will be explained. In FIG. 3, the analog display data 2 is converted into the 2 bit digital data 7 by the A-D converter section 6; the 2 bit digital display data 7 is input to the X driving section 15. The X driving section 15 takes the display digital data 7, in synchronism with the latch clock 3 (FIG. 2), to one latch block of the latch circuit 24 to which a "high" select signal is being input. The latch selector 23 shifts the "high" state of the select signal each time the latch clock 3 is input. The latch circuit 24 takes in the sequentially sent digital display data 7 in the latch blocks 1, 2, . . . 640. When the latch circuit 24 has taken in the digital display data 7 corresponding to one line, i.e. up to latch block 640, the horizontal clock (FIG. 2) is applied to the X driving section 15 to clear the latch selector 23; then the X driving section stands by for next take-in of the digital display data 7. The data latched by the latch circuit 24 is sent to the horizontal latch circuit 29 which latches the data from the latch circuit 24 in synchronism with the horizontal clock 4 (FIG. 2). The horizontal data 30 to 33 which are outputs from the horizontal latch circuit 29 are sent to the decoder 34 and decoded by the decoder blocks 1 to 640 thereof; the decoded values 35 to 38 are output from the decoder 34. In the voltage selector 39, the selector blocks 1 to 640, in accordance with the decoded values, selects tone 0 voltage 9 if the decoded value is "0", tone 1 voltage 10 if it is "1", tone 2 voltage 11 if it is "2", and tone 3 voltage 12 if it is "3". The tone voltages output from the voltage selector blocks are sent to the liquid crystal panel 17 as panel data X1 to X640. Thus, the four value voltages output from the X driving section 15 are applied to the liquid crystal elements corresponding to the line selected by the Y driving section 16 in response to the select voltage 13 sent from the voltage generating circuit 8. In this way, the LCM 1 shown in FIG. 3 can realize four tone display.

Although the four tone display has been adopted in this embodiment, $2^N$ tone display can be realized. More specifically, if the input analog display data is represented by $2^N$ (N is an integer of 1 or more) levels, it is converted into N bit digital data by the A-D converter section 6, the data width in the internal circuits in the X driving circuit 15 is set at N bits, and $2^N$ kinds of tone voltage are supplied to the X driving section 15 to display $2^N$ tones.

Figure 5:
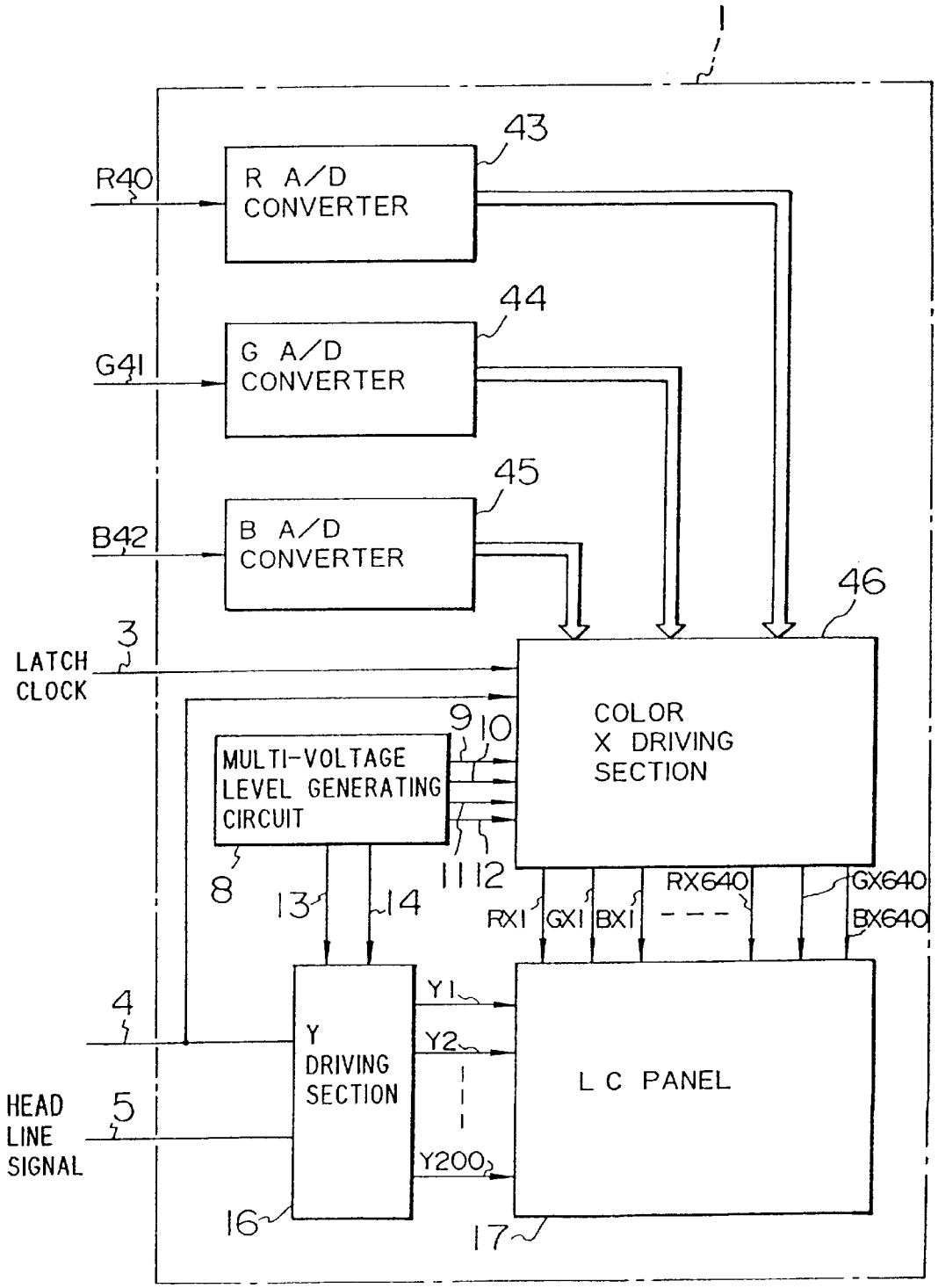
FIG. 5 is a block diagram of an embodiment of a liquid crystal matrix display device (LCM) for color display according to the present invention.

Now referring to FIG. 5, one embodiment of the LCM for multi-color display will be explained. The multi-color display can be realized by arranging color filters of R (red), G (green) and B (blue) in the direction of dots on the liquid crystal panel 17, providing A-D converter sections 43, 44 and 45 for R40, G41 and B42 as input analog display data, and applying the outputs from the R, G and B A-D converter sections 43, 44 and 45 to a color X driving section 46. In this case, the color X driving section 46 has three columns of the arrangement shown in FIG. 4 and thus the corresponding panel data are RX1–RX640, GX1–GX640 and BX1–BX640.

Figure 6:
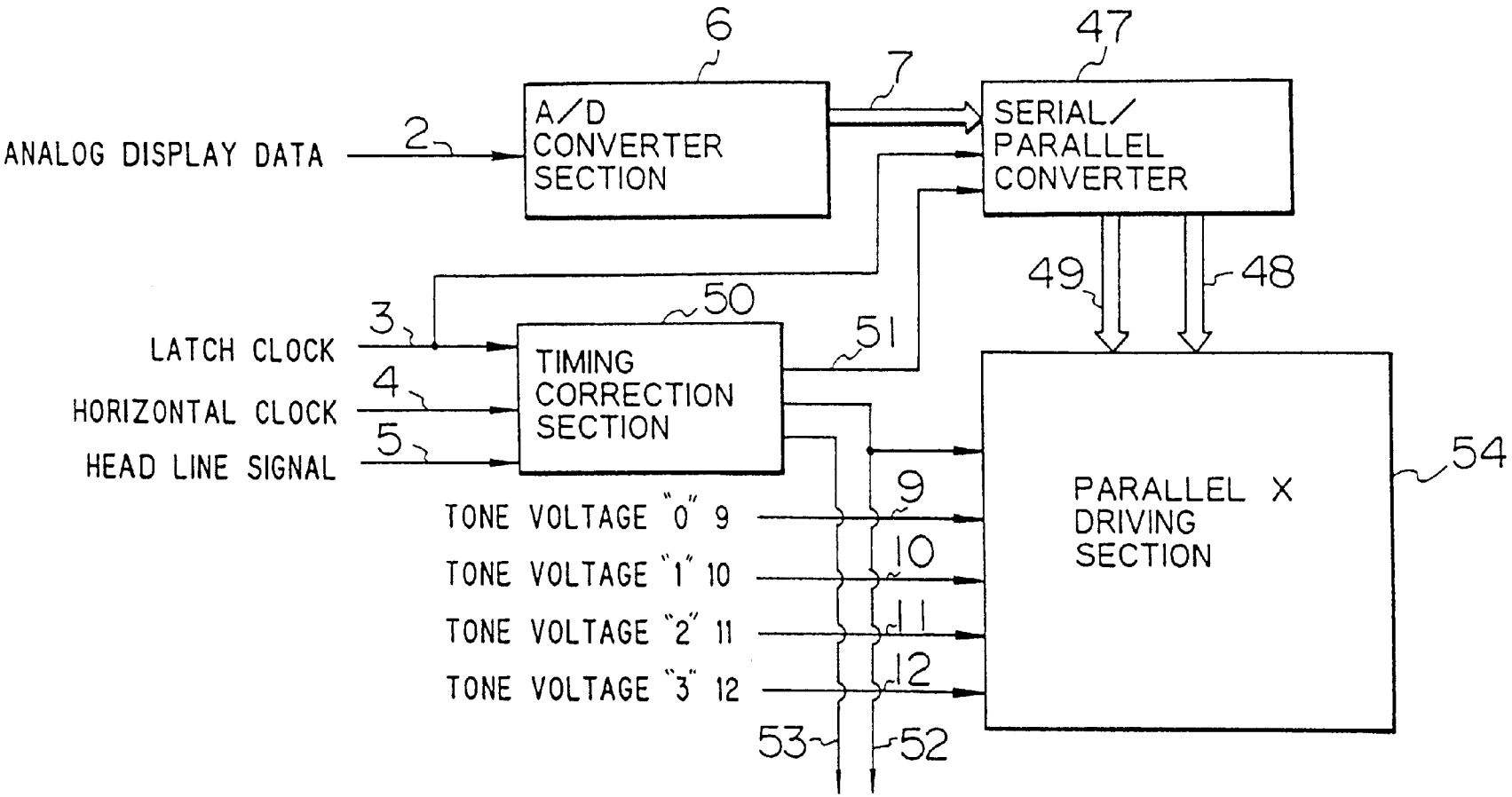
FIG. 6 is a block diagram of the main part of LCM according to the second embodiment of the present invention.
Figure 7:
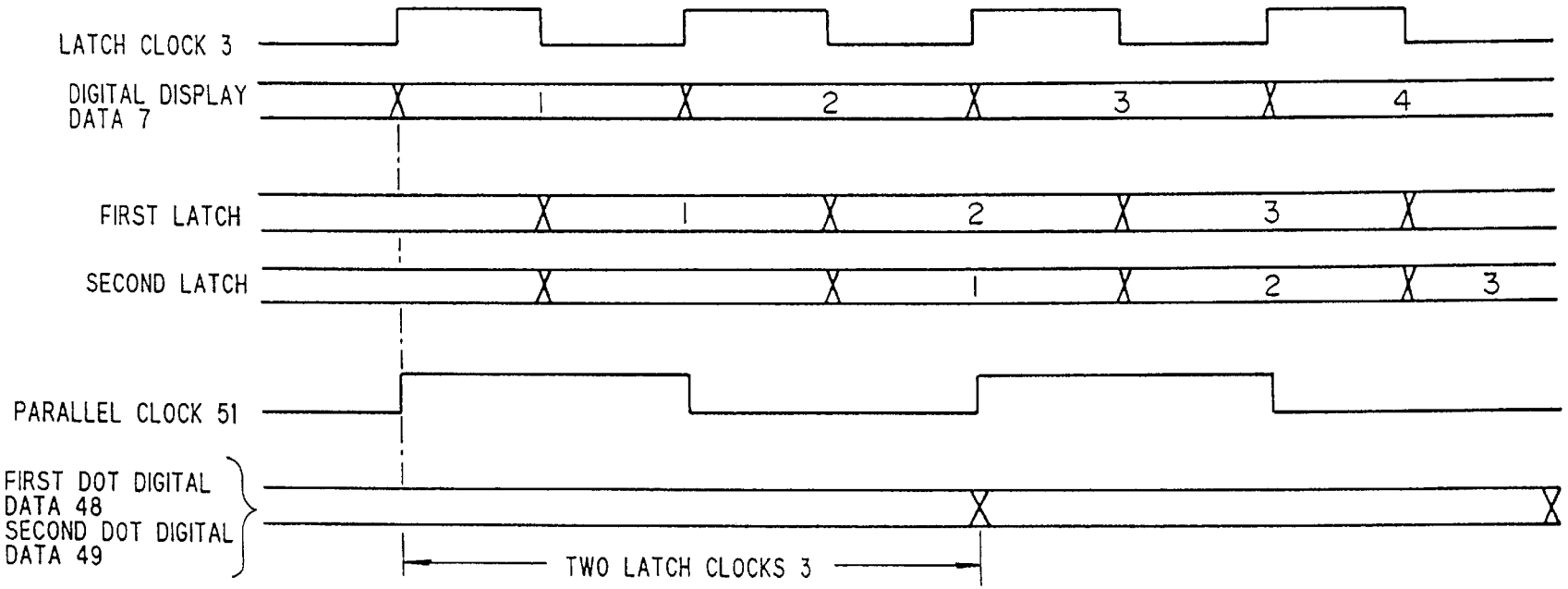
FIG. 7 is a timing chart for explaining the operation of the serial-parallel converter means of FIG. 6.
Figure 8:
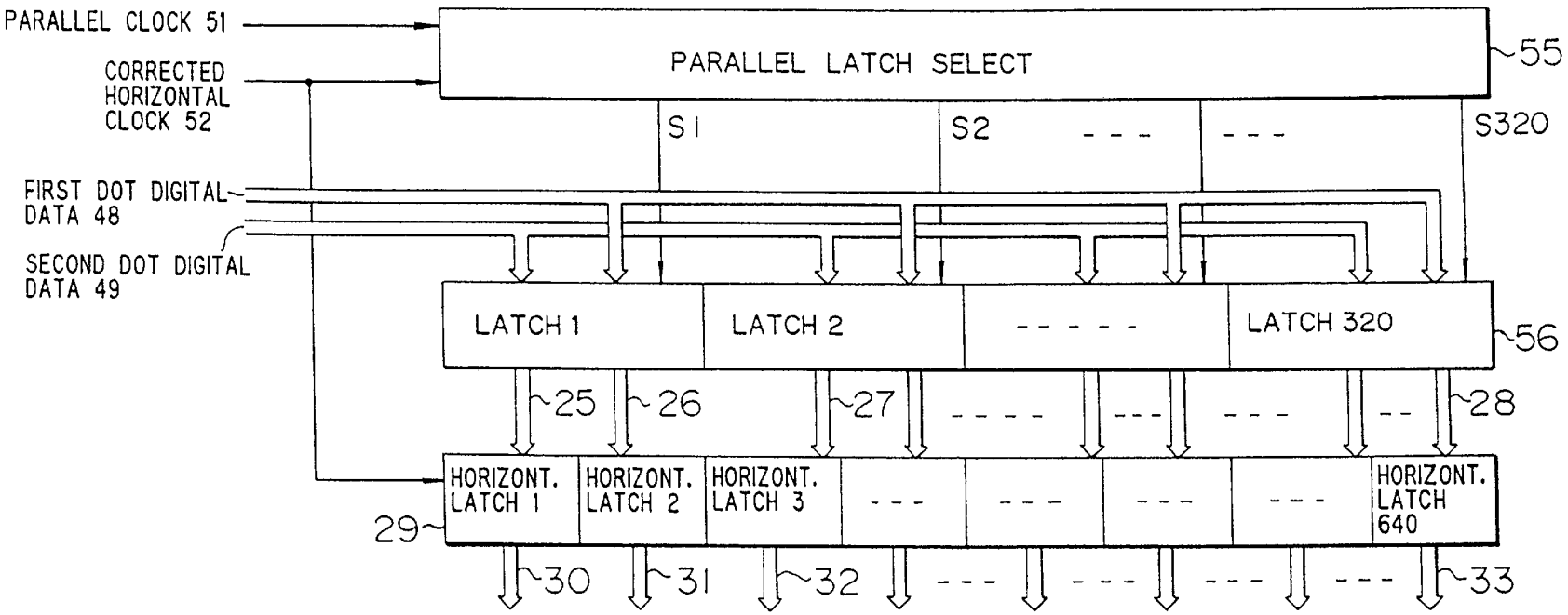
FIG. 8 is a block diagram of an input part of the parallel X driving section of FIG. 6.

With reference to FIGS. 6 to 8, another embodiment of the multi-tone LCM will be explained. In this embodiment, it should be noted that a parallel input of M (M is a positive integer) dots are applied to the X driving section, and it is assumed that M=2.

In FIG. 6, like reference numerals denote like elements in FIG. 3. 47 is a serial-parallel converter section. 48 is a first dot digital data, and 49 is a second dot digital data. The serial-parallel converter section 47 converts 2 bit serial digital data 7 from the A-D converter section 6 into a parallel data consisting of the first dot digital data 48 and the second dot digital data 49, each data consisting of 2 bits. 50 is a timing correction section. 51 is a parallel clock. 52 is a correction horizontal clock. 53 is a correction head line signal. In response to the latch clock 3, the timing correction section 50 generates a parallel clock 51 in synchronism with the parallel data consisting of the first dot digital data 48 and the second dot digital data 49. Further, in order to correct the phase deviation of data due to the serial-parallel conversion of the display data, the timing correction section 50 corrects the horizontal clock 4 and the head line signal 5 using the latch clock 3 to provide a corrected horizontal clock 52 and a corrected head line signal 53. 54 is a parallel X driving section which serves to sequentially take in the 2 bit parallel display data in synchronism with the parallel clock 51.

FIG. 7 is a timing chart showing the operation of the serial-parallel conversion section 47. FIG. 8 is a block diagram of the input port of the parallel X driving section 54. In FIG. 8, 55 is parallel latch select which is cleared by the corrected horizontal clock 52 and thereafter sequentially boosts select signals S1, S2, . . . S320 to "high". 56 is a parallel latch circuit; the latch block thereof for which the select signal is "high" latches simultaneously the first dot digital data 48 and second dot digital data 49 at the timing of the parallel clock 51. The other reference numerals in FIG. 8 denote like elements in FIG. 4.

The operation of the multi-tone LCM shown in FIG. 6 will be explained. The analog display data 2 having four value voltage levels is the 2 bit digital display data 7 by the analog-digital converter section 6. This digital display data 7 is converted into 2 bit parallel data, as shown in FIG. 7, to provide the first dot digital data 48 and second dot digital data 49 which are in synchronism with the parallel clock 51. Then, as shown in FIG. 7, owing to the serial-parallel conversion, the phase of the output data lags the input data by 2 (two) latch clocks 3. In order to correct this lag, the timing correction section 50 also causes the horizontal clock 4 and the head line signal 5 to lag by 2 latch clocks 3. The resulting corrected horizontal clock 52 and corrected head timing signal 53 are applied to the X driving section 54 and the Y driving section 16. As seen from FIG. 8, the X driving section 54 takes the first dot digital data 48 and the second dot digital data 49, in synchronism with the parallel clock 51, into its one block to which the "high" select signal is applied from the parallel latch select 55. The parallel latch select 55 is cleared by the corrected horizontal clock 52 and thereafter sequentially boosts the select signals S1 to S320 to "high". Thus, the parallel latch circuit 52 also latches the data in the order of latch blocks 1, 2, . . . 320 to finally latch the data corresponding to one line. The outputs from the blocks of the parallel latch circuit 56 are latched in the horizontal latch circuit 52 at the timings of the corrected horizontal clock 52. The following operation is the same as that in FIG. 4. Thus, parallel data X1 to X640 are provided as panel data.

As understood from the above explanation, two dots can be used as an input to the X driving section 46 by providing the serial-parallel conversion section 47, causing the internal port of the X driving section 46 to simultaneously latch two dots and providing the timing correction section for correcting the phase lag due to the serial-parallel conversion. This can enhance the operation speed of the circuits successive to the A-D converter section 6. In another embodiment of the invention, the timing correction section 50 is not required when the input timing is determined in consideration of the phase delay in the serial-parallel conversion section 47 (two latch clocks 3) so that the horizontal clock 4 and the head line signal 5 can be directly used without correction. Incidentally, although in this embodiment, the input to the X driving was 2 bits for each of 2 dots, the input of N bit(s) (N is an integer of 1 or more) for each of M dots (M is an integer of 2 or more) can be realized in the same way.

Figure 9:
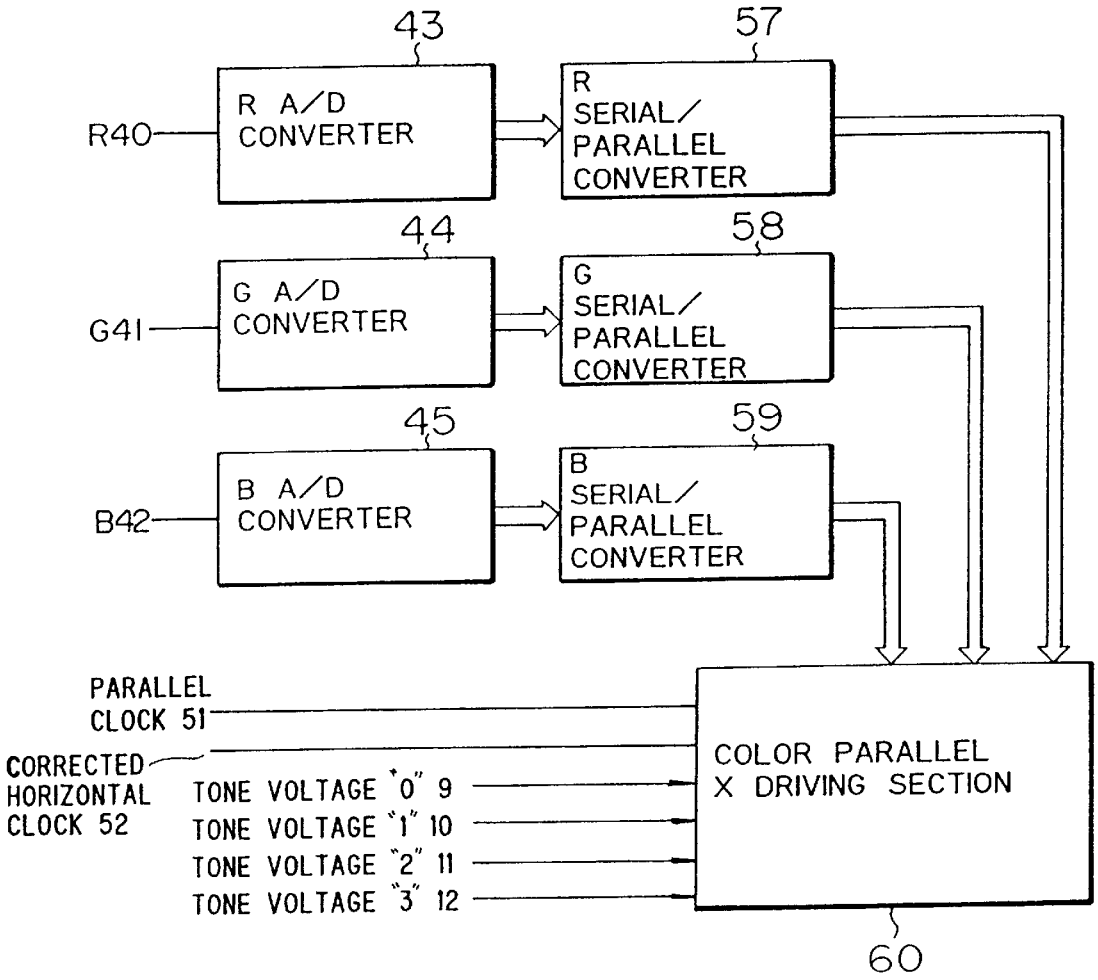
FIG. 9 is a block diagram of the main part of another embodiment of a liquid crystal matrix display device for color display according to the present invention.

A second embodiment of the LCM for color display as shown in FIG. 9 can be realized by providing R, G and B serial-parallel converter sections 57, 58 and 59, and providing a color parallel X driving section 60 with three columns of the arrangement of FIG. 8.

Further, although the explanation hitherto made was directed to a liquid crystal display device, the same idea can be also applied to the other display devices such as a plasma display, EL display, etc.

In accordance with the present invention, an LCM for multi-tone display or multi-color can be realized thereby to decrease the number of input lines to LCM. Moreover, by using an analog input to decrease the number of data bits, noise to be generated can be reduced. Further, by carrying the parallel operation of the X driving section, the operation speed can be enhanced. Furthermore, since the voltages in accordance with N bit decoded values can be selected as outputs from the X driving section, tone voltage with less fluctuation can be provided.

What is claimed is:

1. A matrix type image display device, comprising:

a Y direction driving circuit for providing a scanning electrode with a selected voltage at each one horizontal scanning period;

an analog/digital converter circuit for receiving an analog image data input signal and converting said analog image data into digital multi-tone image data;

voltage generating means for generating a plurality of tone voltages;

a serial latch circuit for serially latching said digital multi-tone image data;

a parallel latch circuit for latching in parallel the serially latched digital multi-tone image data and holding said parallel latched digital multi-tone image data during one horizontal scanning period;

decoder means for converting said parallel latched digital multi-tone image data into voltage selecting data;

voltage outputting means for receiving said tone voltages and said voltage selecting data, and for outputting only one of said tone voltages having a constant voltage level as multi-tone image data-in accordance with said voltage selecting data during one horizontal scanning period, wherein each of said tone voltages when output by said voltage output means has a constant voltage level for one horizontal scanning period; and a matrix display panel which receives said multi-tone image data corresponding to said one of said tone voltages output from said voltage outputting means in said one horizontal scanning period and displays a multi-tone image based on said multi-tone image data.

2. A matrix type image display device, comprising:

a Y direction driving circuit for providing a scanning electrode with a selected voltage at each one horizontal scanning period;

an analog/digital converter circuit for receiving an analog image data input signal and converting said analog image data into digital multi-tone image data;

a serial latch circuit for serially latching said digital multi-tone image data;

a parallel latch circuit for latching in parallel the serially latched digital multi-tone image data and holding said parallel latched digital multi-tone image data during one horizontal scanning period;

decoder means for converting said parallel latched digital multi-tone image data into voltage selecting data;

voltage generating means for generating a plurality of tone voltages;

voltage selecting means for selecting only one of said tone voltages in accordance with said voltage selecting data as multi-tone image data during one horizontal scanning period; and a matrix display panel which receives said multi-tone image data corresponding to said one of said tone voltages output from said voltage selecting means in said one horizontal scanning period and displays a multi-tone image based on said multi-tone image data, wherein each of said tone voltages when received by said matrix display panel or multi-tone image data has a constant voltage level during one horizontal scanning period.

3. A method for serially supplying voltages to a plurality of display elements for one horizontal line of any one of said display elements, said display element including a plurality of horizontal lines and displays a multi-tone image, said method comprising the steps of:

converting tone image information, indicated by an analog image data, into digital multi-tone image data;

serially latching said digital multi-tone image data;

latching in parallel the serially latched digital multi-tone image data for one horizontal line;

converting said parallel latched digital multi-tone image data into voltage selecting data;

generating a plurality of multi-tone displaying voltages; and supplying a single tone voltage having a constant voltage level according to said voltage selecting data and said plurality of multi-tone displaying voltages to said display elements in a period for latching data for one horizontal line.

4. An information processing system comprising:

an information device for outputting an analog display data; and an image display device, said image display device including:

a matrix display panel having plural X direction signal lines and plural Y direction signal lines, said plural X direction signal lines and said plural Y direction signal lines intersecting at intersecting points, the intersecting points of said matrix being pixels of a display image, an A-D converter circuit for receiving said analog display data and converting said analog display data into digital display data, a Y direction driving circuit for driving said plural Y direction signal lines by sequentially providing a select signal to said plural Y direction signal lines, a voltage generator for simultaneously generating a plurality of discrete output signals at respectively different voltage levels, each of said voltage levels being a constant voltage level, and an X direction driving circuit for receiving digital display data and for providing image signals to said plural X direction signal lines, wherein said X direction driving circuit includes a selector circuit for selecting one of said discrete output signals from said voltage generator as one of said image signals in accordance with said digital display data and providing one image signal formed by said one discrete output signal to said plural X direction signal lines, wherein said matrix display panel comprises a liquid crystal display panel, wherein said liquid crystal display panel comprises liquid crystal cells capable of distinguishably displaying colors corresponding to N bits of information for one pixel, N being a positive integer, and wherein said voltage generator generates said discrete output signals at $2^N$ different voltage levels.

5. An information processing system according to claim 4, wherein said liquid crystal display panel includes:

a plurality of display elements radiating different colors, a combination of three of said plurality of display elements, each combination being of a different color, said combination forming one pixel radiating a blended color, said plural X direction signal lines comprises three signal lines corresponding to said three different colors, and said A-D converter circuit comprises a circuit for receiving N different kinds of color image analog signals and converting them into N different kinds of color image digital signals.

6. An information processing system comprising:

an information device for outputting an analog display data; and an image display device, said image display device including:

a matrix display panel having plural X direction signal lines and plural Y direction signal lines, said plural X direction signal lines and said plural Y direction signal lines intersecting at intersecting points, the intersecting points of said matrix being pixels of a display image, an A-D converter circuit for receiving said analog display data and converting said analog display data into digital display data, a Y direction driving circuit for driving said plural Y direction signal lines by sequentially providing a select signal to said plural Y direction signal lines, a voltage generator for simultaneously generating a plurality of discrete output signals at respectively different voltage levels, each of said voltage levels being a constant voltage level, and an X direction driving circuit for receiving digital display data and for providing image signals to said plural X direction signal lines, wherein said X direction driving circuit includes a selector circuit for selecting one of said discrete output signals from said voltage generator as one of said image signals in accordance with said digital display data and providing one image signal formed by said one discrete output signal to said plural X direction signal lines, wherein said matrix display panel comprises a liquid crystal display panel, and wherein said plural different voltage levels are $2^N$ voltage levels.

7. An information processing system comprising:

an information device for outputting analog display data including first and second dot analog data; and an image display device, said image display device including:

a matrix display panel having plural X direction signal lines and plural Y direction signal lines, said plural X direction signal lines intersecting said plural Y direction signal lines at intersecting points, the intersecting points of said matrix being pixels of a display image, an A-D converter circuit for receiving said analog display data and converting said analog display data into serial digital display data, a Y direction driving circuit for driving said plural Y direction signal lines by sequentially providing a select signal to said plural Y direction signal lines, a voltage generator for simultaneously generating a plurality of discrete output signals at respectively different voltage levels, each of said voltage levels being a constant voltage level, a serial-to-parallel converter circuit to convert said serial digital display data into parallel digital display data, said parallel digital display data including first and second dot digital data, and a parallel X direction driving circuit for receiving said first and second dot digital data and for providing image signals to said plural X direction signal lines, said X direction driving circuit including a selector circuit for selecting one of said discrete output signals from said voltage generator as one of said image signals in accordance with said digital display data and providing said one image signal formed by said one discrete output signal to said plural X direction signal lines, wherein said image display device further comprises:

a timing correction circuit for correcting a phase deviation between the serial digital display data and the parallel digital display data.

8. An information processing system according to claim 7, wherein said timing correction circuit comprises a horizontal clock correction circuit to generate a corrected horizontal clock signal, said parallel X direction driving circuit receiving said corrected horizontal clock signal.

9. An information processing system according to claim 7, wherein said timing correction circuit generates a parallel clock which corresponds to said parallel digital image data.

10. An information processing system according to claim 7, wherein said timing correction circuit further comprises a corrected head line signal.

11. An information processing system comprising:

an information device for outputting analog image data; and an image display device, said image display device including:

a Y direction driving circuit for generating a selecting voltage by which one of a plurality of scanning electrodes is selected at every horizontal scanning period, an analog/digital converter circuit for receiving an analog image data signal and converting said analog image data signal into digital multi-tone image data, a serial latch circuit for serially latching said digital multi-tone image data, a parallel latch circuit for latching in parallel the serially latched digital multi-tone image data and holding said parallel latched digital multi-tone image data during a horizontal scanning period;

a voltage outputting circuit for converting said parallel latched digital multi-tone image data into voltage selecting data, generating a plurality of tone voltages, and outputting one of said tone voltages having a constant voltage level or multi-tone image data in accordance with said voltage selecting data during one horizontal scanning period, and a matrix display panel which is provided with said multi-tone image data formed by said one voltage from said voltage outputting circuit in one horizontal scanning period for displaying a multi-tone image.

12. An information processing system, comprising:

an information device for outputting analog image data; and an image display device, said image display device including:

a Y direction driving circuit for providing a scanning electrode with a selected voltage at every horizontal scanning period, an analog/digital converter circuit for receiving an analog image data signal and converting said analog image data signal into digital multi-tone image data;

a serial latch circuit for serially latching said digital multi-tone image data, a parallel latch circuit for latching in parallel the serially latched digital multi-tone image data and holding said parallel latched digital multi-tone image data during one horizontal scanning period;

decoder means for converting said parallel latched digital multi-tone image data into voltage selecting data;

voltage generating means for generating a plurality of tone voltages;

voltage selecting means for selecting one of said tone voltages as multi-tone image data in accordance with said voltage selecting data during one horizontal scanning period, and a matrix display panel which is provided with said multi-tone image data formed by said one voltage from said voltage selecting means in one horizontal scanning period for displaying a multi-tone image.

13. An image display device comprising:

a display unit having a plurality of continuous display dots;

a Y direction driving circuit for determining which of said plurality of continuous display dots is supplied with a display voltage;

an A/D converting circuit for converting input analog image data into digital image data of N bits (N is an integer);

a data latch circuit for receiving and holding said digital image data of N bits;

a decode circuit for decoding the digital image data held by said data latch circuit; and a voltage output circuit for outputting a single multi-tone voltage having a constant voltage level as the display voltage corresponding to a decoded result of said decode circuit to the display dot selected by said Y direction driving circuit during a period in which said Y direction driving circuit is determining said one of said plurality of continuous display dots supplied with the display voltage, wherein $2^N$ different voltage levels are provided for said multi-tone voltage output from said voltage output circuit in accordance with the decoded result of said decode circuit.

14. An information processing system comprising:

an information device for outputting analog image data; and an image display device, said image display device including:

a display unit having a plurality of continuous display dots, a Y direction driving circuit for selecting a display voltage for each of said continuous display dots, an A/D converting circuit for converting input analog image data into digital display data of N bits (N is an integer), a data latch circuit for receiving and holding said digital image data of N bits, a decode circuit for decoding the digital image data held by said data latch circuit, and a voltage output circuit for outputting a single multi-tone voltage having a constant voltage level as the display voltage corresponding to a decoded result of said decode circuit to the display voltage selected by said Y direction driving circuit during a period that said Y direction driving circuit is selecting display voltages for respective ones of said plurality of continuous display dots, wherein $2^N$ different voltage levels are provided for said multi-tone voltage output from said voltage output circuit in accordance with the decoded result of said decode circuit.

15. A method of displaying a multi-tone image, comprising the steps of:

producing multi-tone voltage selecting data based on analog image data including multi-tone image data; and outputting a multi-tone voltage having a constant voltage level during one horizontal scanning period in accordance with said multi-tone voltage selecting data.

16. A method of displaying a multi-tone image according to claim 15, wherein said step of producing the multi-tone voltage selecting data includes the steps of:

converting said analog image data including multi-tone image data into digital image data;

latching and holding said digital image data during one horizontal scanning period; and decoding the held digital image data and producing said multi-tone voltage selecting data.

17. A method of displaying a multi-tone image according to claim 16, wherein said digital display data is N (N is an integer) bits data.

18. A method of displaying a multi-tone image according to claim 15, wherein said step of outputting a multi-tone voltage having a constant voltage level includes the steps of:

producing a plurality of different multi-tone voltages each having a constant voltage level; and selecting one of said different multi-tone voltages.

19. A method of displaying a multi-tone image according to claim 15, wherein $2^N$ kinds of voltage levels are provided for said multi-tone voltage.

20. A method of displaying multi-tone image data output from an information device on an image display device, said method comprising the steps of:

producing multi-tone image data by said information device;

producing multi-tone voltage selecting data based on analog image data including multi-tone display data; and outputting a multi-tone voltage having a constant voltage level during one horizontal scanning period in accordance with said multi-tone voltage selecting data to said image display device.

21. A method of displaying multi-tone image data according to claim 20, wherein said step of producing multi-tone voltage selecting data includes the steps of:

converting said analog image data including multi-tone display data into digital display data;

latching and holding said digital display data during one horizontal scanning period; and decoding the held digital display data and producing said multi-tone voltage selecting data.

22. A method of displaying multi-tone image data according to claim 21, wherein said digital display data is N (N is an integer) bits data.

23. A method of displaying multi-tone image data according to claim 20, wherein said step of outputting a multi-tone voltage having a constant voltage level includes the steps of:

producing a plurality of different multi-tone voltages each having a constant voltage level; and selecting one of said different multi-tone voltages.

24. A method of displaying multi-tone image data according to claim 20, wherein $2^N$ kinds of voltage levels are provided for said multi-tone voltage.

25. A matrix type image display device, comprising:

a Y direction driving circuit for generating a selecting voltage by which one of a plurality of scanning electrodes is selected at every horizontal scanning period;

an analog/digital converter circuit for receiving an analog image data signal and converting said analog image data signal into digital multi-tone image data;

a serial latch circuit for serially latching said digital multi-tone image data;

a parallel latch circuit for latching in parallel the serially latched digital multi-tone image data and holding said parallel latched digital multi-tone image data during one horizontal scanning period;

a voltage outputting circuit for converting said parallel latched digital multi-tone image data into voltage selecting data, said voltage selecting data being constant during one horizontal scanning period, and for outputting a single tone voltage having a constant voltage level as multi-tone image data in accordance with said voltage selecting data during one horizontal scanning period; and a matrix display panel which is provided with said multi-tone image data formed by said single tone voltage from said voltage outputting circuit in one horizontal scanning period for displaying a multi-tone image.

* * * * *